US011308878B2

(12) United States Patent
Liu et al.

(10) Patent No.: US 11,308,878 B2
(45) Date of Patent: Apr. 19, 2022

(54) PIXEL DRIVING CIRCUIT AND DRIVING METHOD THEREOF, DISPLAY PANEL

(71) Applicant: Shenzhen China Star Optoelectronics Semiconductor Display Technology Co., Ltd., Guangdong (CN)

(72) Inventors: Qikun Liu, Guangdong (CN); Jiexin Zheng, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/972,624

(22) PCT Filed: Jan. 7, 2020

(86) PCT No.: PCT/CN2020/070673

§ 371 (c)(1),
(2) Date: Dec. 7, 2020

(87) PCT Pub. No.: WO2021/128470

PCT Pub. Date: Jul. 1, 2021

(65) Prior Publication Data

US 2021/0366390 A1 Nov. 25, 2021

(30) Foreign Application Priority Data

Dec. 24, 2019 (CN) ..... 201911349977.3

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2320/0238* (2013.01)

(58) Field of Classification Search
CPC ..... G09G 3/3233; G09G 3/3291; G09G 2320/0238
See application file for complete search history.

(56) References Cited

U.S. PATENT DOCUMENTS

2009/0206770 A1* 8/2009 Hong ..... G09G 3/3233 315/291
2010/0033409 A1* 2/2010 Park ..... G09G 3/3233 345/76
2010/0220093 A1 9/2010 Choi
(Continued)

FOREIGN PATENT DOCUMENTS

CN 101866619 A 10/2010
KR 20080071304 A 8/2008

*Primary Examiner* — Stacy Khoo
(74) *Attorney, Agent, or Firm* — Mark M. Friedman

(57) ABSTRACT

A pixel driving circuit and a driving method thereof, and a display panel are provided. The pixel driving circuit includes a first transistor (T1), a second transistor (T2), a third transistor (T3), a first storage capacitor (Cst1), a second storage capacitor (Cst2) and an organic light emitting element (OLED). By appropriately designing capacitance of the two capacitors and dividing a gate voltage of the first transistor (T1), it can be ensured that a black screen is achieved and contrast of a display panel is improved even though a negative drift is seriously caused on a threshold voltage of T1.

8 Claims, 3 Drawing Sheets

(56) References Cited

U.S. PATENT DOCUMENTS

| | | | | |
|---|---|---|---|---|
| 2014/0159609 | A1* | 6/2014 | Xie | H01L 27/3265 315/228 |
| 2018/0277038 | A1* | 9/2018 | Takahara | H01L 51/525 |
| 2019/0156748 | A1* | 5/2019 | Jin | G09G 3/3258 |
| 2020/0202784 | A1* | 6/2020 | Kim | G09G 3/3258 |

* cited by examiner

PIXEL DRIVING CIRCUIT AND DRIVING METHOD THEREOF, DISPLAY PANEL

FIELD OF THE DISCLOSURE

The present application relates to display technologies, and more particularly to a pixel driving circuit and a driving method thereof, and a display panel.

DESCRIPTION OF RELATED ARTS

Active matrix organic light emitting diode (AMOLED) displays have superior performance and is loved by consumers. Compared with liquid crystal display (LCD) panels, organic light emitting diode (OLED) display panels have very high contrast and can achieve a darker screen than the LCD, and thus visual experience is improved. For large-scaled OLED TV display panels, many display panel manufacturers are actively developing ink-jet printing (Ink-Jet Printing, IJP) technologies due to higher production cost of WOLEDs. However, because activation voltage (about 2V) of UP OLED devices is much lower than that of the WOLED (about 8V), it is easy to cause a situation where a black screen cannot be achieved. The specific analysis is as follows:

As shown in FIG. 1, most of large-scaled indium gallium zinc oxide (IGZO) thin-film transistor (TFT) substrates adopts a pixel driving circuit of 3T1C. However, when driving the IJP OLED devices using the pixel driving circuit, a pure black screen cannot be achieved if a negative drift is seriously caused on a threshold voltage Vth driving the TFT. Explanation are provided in detail below.

a) when the 3T1C pixel driving circuit operates, the difference between a reference voltage (Vref) and a common ground voltage (VSS) cannot be higher than the threshold voltage of the OLED in order to ensure that the OLED will not be activated during a capacitor is charged. The threshold voltage of the IJP OLED device is relatively low, about 2V.

b) it is assumed that the threshold voltage of the IJP OLED device is 2V, VSS=0V and the voltage of black screen data (Data)=0V. Then, a maximum of Vref is 2V.

c) when Vth_TFT>−2 V, a pure black screen can be achieved by adjusting Vref to switched off the driving TFT.

d) however, when Vth_TFT<−2 V, the driving TFT cannot be switched off by adjusting Vref and thus a pure black screen cannot be achieved. This greatly reduces the contrast of the OLED display panel.

Technical Problems

The objective of the present disclosure is to provide a pixel driving circuit and a driving method thereof, and a display panel, for solving the technical problems—an OLED display panel cannot achieve a pure black image or screen and the contrast of the OLED display panel decreases, caused when a threshold voltage is negative in the existing axis.

Technical Solutions

To achieve above objective, the present disclosure provides a pixel driving circuit, including: a first transistor (T1), a gate of the first transistor (T1) connected to a first node (A), a source of the first transistor (T1) connected to a second node (B), a drain of the first transistor (T1) fed by a power source voltage (Vdd); a second transistor (T2), the gate of the second transistor (T2) connected to a third node (C) and fed by a writing signal (WR), the source of the second transistor (T2) fed by a data signal (Data), the drain of the second transistor (T2) connected to the second node (B); a third transistor (T3), the gate of the third transistor (T3) fed by a reading signal (RD), the source of the third transistor (T3) connected to the second node (B), the drain of the third transistor (T3) connected to a reference voltage (Vref); a first storage capacitor (Cst1), one end of which is connected to the third node (C) and the other end of which is connected to the first node (A); a second storage capacitor (Cst2), one end of which is connected to the first node (A) and the other end of which is connected to the second node (B); and an organic light emitting element (OLED), an anode of which is connected to the second node (B) and a cathode of which is connected to a common ground voltage (Vss).

Further, a ratio of capacity of the first storage capacitor (Cst1) to capacity of the second storage capacitor (Cst2) is greater than 0.2.

Further, the first transistor (T1), the second transistor (T2) and the third transistor (T3) are any one of a low temperature poly-silicon thin-film transistor, an oxide semiconductor thin-film transistor and an amorphous-silicon (a-Si) thin-film transistor.

Further, all of the writing signal (WR), the reading signal (RD) and the data signal (Data) are provided by the external integrated circuit (IC).

Further, the first transistor (T1) is configured to provide a driving current to the organic light emitting element (OLED) and brightness of the organic light emitting element (OLED) is controlled by the driving current.

To achieve above objective, the present disclosure further provides a driving method, including steps of: an initial stage, at which the pixel driving circuit is initialized; a data input stage, at which an external integrated circuit (IC) provides a voltage to the data signal (Data), the voltage is divided by using the first storage capacitor (Cst1) and the second storage capacitor (Cst2), and the voltage is pulled down and written to the gate of the first transistor (T1); and a light emission stage, at which the pixel driving circuit provides a driving current which is provided to the organic light emitting element (OLED) for driving the organic light emitting element (OLED) to emit light for displaying images.

Further, at the data input stage, the writing signal (WR), the reading signal (RD), the data signal (Data) and the reference voltage (Vref) obtain a high voltage level, all of the first transistor (T1), the second transistor (T2) and the third transistor (T3) are turned on, and the second storage capacitor (Cst2) is charged.

Further, when entering the light emission stage from the data input stage, the writing signal (WR) is changed from a high voltage level to a low voltage level, the voltage of the data signal (Data) is pulled down, and a turned-off state is achieved by the first transistor (T1) when a black image is displayed on a display panel.

Further, at the light emission stage, all of the waiting signal (WR), the reading signal (RD) and the data signal (Data) obtain a low voltage level, and the organic light emitting element (OLED) emit light.

A display panel includes the afore-described pixel driving circuit.

Beneficial Effects

The technical effects of the present disclosure are described below. A pixel driving circuit and a driving method thereof, and a display panel are provided. By appropriately designing capacitance of the two capacitors and dividing a gate voltage of the first transistor (T1), it can be ensured that a black screen is achieved and contrast of a display panel is improved even though a negative drift is seriously caused on a threshold voltage of T1.

DESCRIPTION OF DRAWINGS

The technical solutions and other beneficial effects of the present application will be more apparent with reference to the detailed descriptions of the embodiments of the present application below in accompanying with the drawings.

DESCRIPTION OF EMBODIMENTS OF THE DISCLOSURE

The technical solutions in the embodiments of the present application will be clearly and completely described below with reference to accompanying drawings of the embodiments of the present application. Obviously, the described embodiments are merely a part of embodiments of the present application and are not all of the embodiments. Based on the embodiments of the present application, all the other embodiments obtained by those of ordinary skill in the art without making any inventive effort are within the scope the present application.

In the description of the present application, it should be noted that unless otherwise explicitly specified or limited, the terms "installed", "connected", and "connection" should be construed broadly, for example, a fixed connection, a removable connection, or integrally connected. These terms may be a mechanical connection, and may also be an electrical connection or communication. Moreover, these terms can be directly attached, be indirectly connected through an intermediate medium, and may be internally communicated with two components or the interaction relationship between two components. For persons skilled in the art, they can understand the specific meaning of the terms in the present application based on specific conditions.

Figure 1:
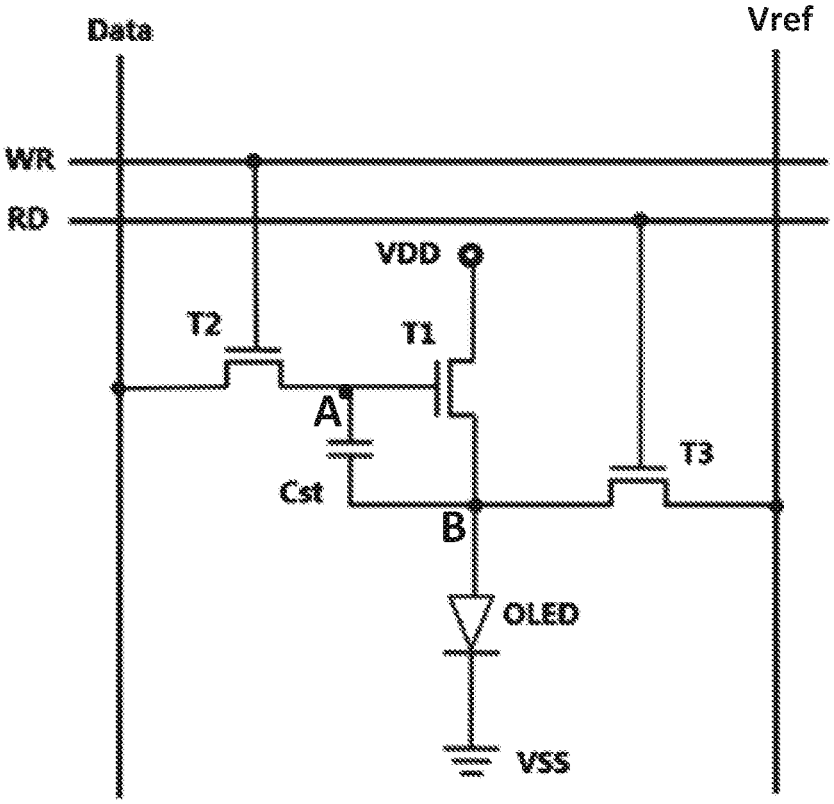
FIG. 1 is a diagram showing a pixel driving circuit of 3T1C in an existing art.
Figure 2:
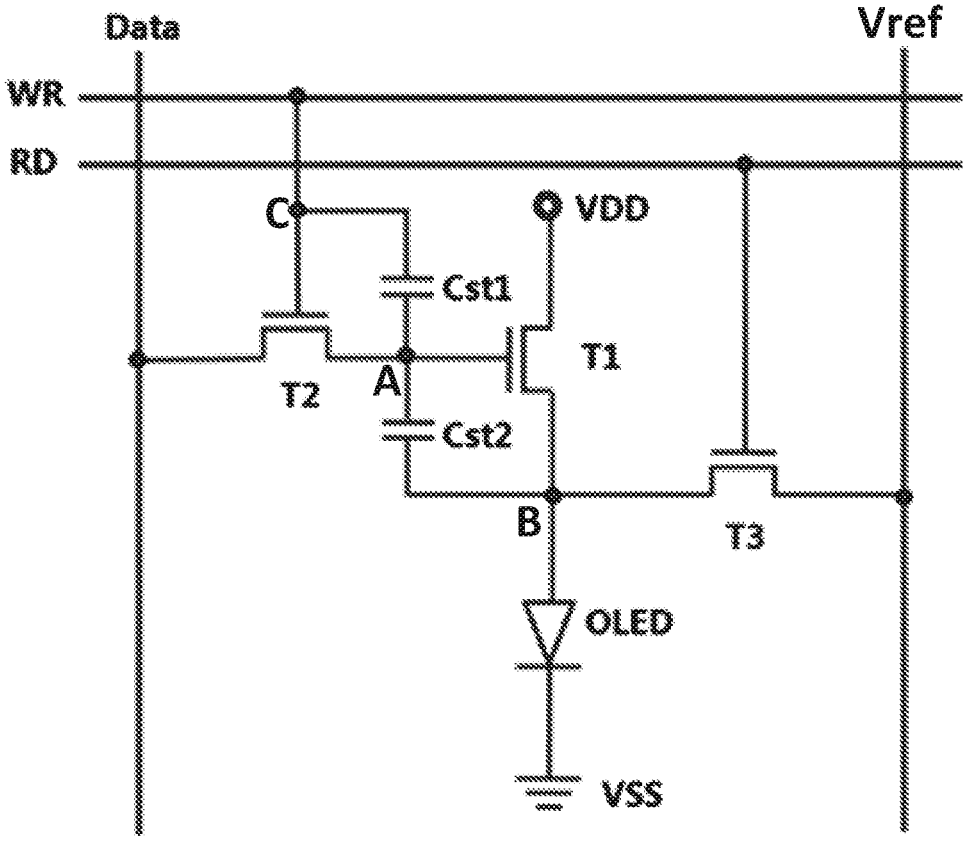
FIG. 2 is a diagram showing a pixel driving circuit of 3T1C in present embodiment.

As shown in FIG. 2, the present embodiment provides a pixel driving circuit, including: a first transistor (T1), a gate of the first transistor (T1) connected to a first node (A), a source of the first transistor (T1) connected to a second node (B), a drain of the first transistor (T1) fed by a power source voltage (Vdd); a second transistor (T2), the gate of the second transistor (T2) connected to a third node (C) and fed by a writing signal (WR), the source of the second transistor (T2) fed by a data signal (Data), the drain of the second transistor (T2) connected to the second node (B); a third transistor (T3), the gate of the third transistor (T3) fed by a reading signal (RD), the source of the third transistor (T3) connected to the second node (B), the drain of the third transistor (T3) connected to a reference voltage (Vref); a first storage capacitor (Cst1), one end of which is connected to the third node (C) and the other end of which is connected to the first node (A); a second storage capacitor (Cst2), one end of which is connected to the first node (A) and the other end of which is connected to the second node (B); and an organic light emitting element (OLED), an anode of which is connected to the second node (B) and a cathode of which is connected to a common ground voltage (Vss).

Specifically, the power source voltage (Vdd) is at a high voltage level, the common ground voltage (Vss) is at a low voltage level, the potential of the reference voltage (Vref) is lower than the potential of the power source voltage (Vdd) and is higher than the potential of the common ground voltage (Vss).

The first transistor (T1) is a driving transistor and is configured to provide a driving current to the organic light emitting element (OLED) and brightness of the organic light emitting element (OLED) is controlled by the driving current.

The second transistor (T2) is a switch transistor and has a gate controlled by the writing signal (WR), a source fed by the data signal (Data) and a drain connected to the first node (A), and is electrically connected to the first transistor (T1), the first storage capacitor (Cst1) and the second storage capacitor (Cst2). The writing signal (WR) is provided by an external integrated circuit (IC).

The first storage capacitor (Cst1) is connected between the node A and the node C and is configured to divide a gate voltage of the first transistor (T1).

The second storage capacitor (Cst2) is connected between the node A and the node B and is configured to maintain a predetermined voltage within a period of time of one frame.

The third transistor (T3) is controlled by the reading signal (RD) applying to a gate node, thereby applying the reference voltage (Vref) to the second node (B) (e.g., a source node of the first transistor (T1)). The reading signal (RD) is provided by the external integrated circuit (IC).

In the present embodiment, the first transistor (T1), the second transistor (T2) and the third transistor (T3) are any one of a low temperature poly-silicon thin-film transistor, an oxide semiconductor thin-film transistor and an amorphous-silicon (a-Si) thin-film transistor. All of the writing signal (WR), the reading signal (RD) and the data signal (Data) are provided by the external integrated circuit (IC).

A ratio of capacity of the first storage capacitor (Cst1) to capacity of the second storage capacitor (Cst2) is greater than 0.2.

Figure 3:
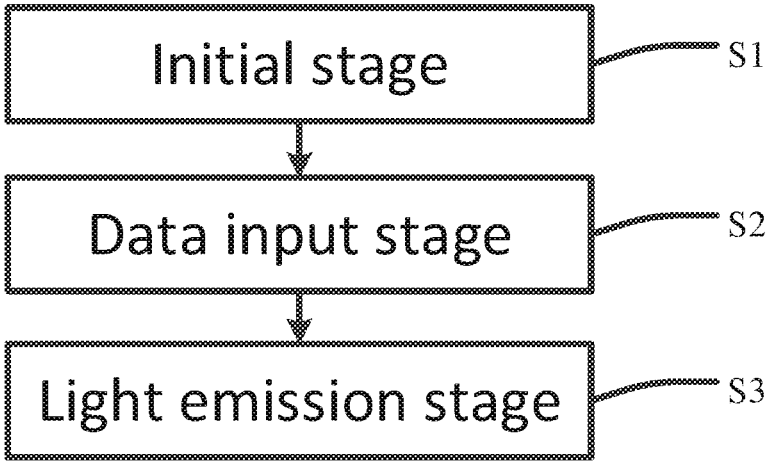
FIG. 3 is a timing chart of the pixel driving circuit in the present embodiment.
Figure 4:
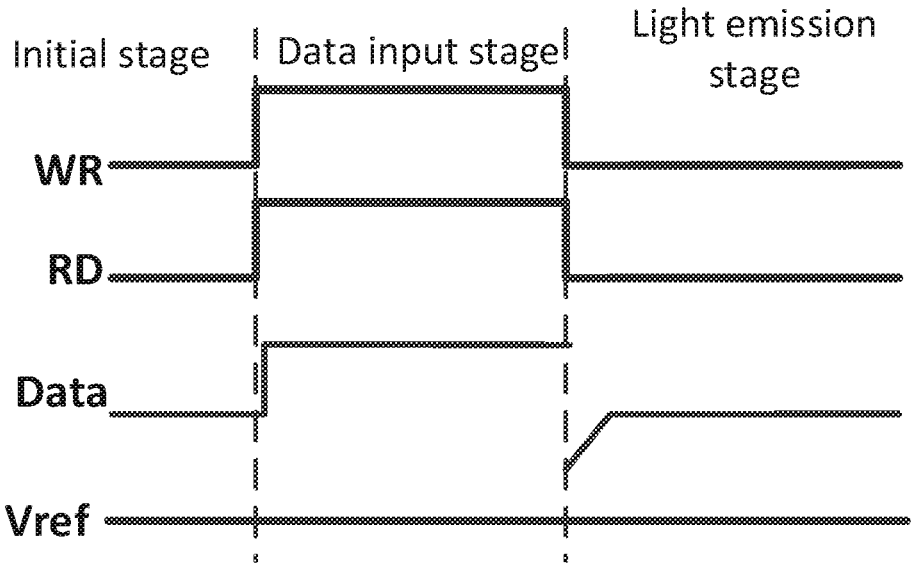
FIG. 4 is a flowchart of a method for driving a pixel driving circuit in the present embodiment.

As shown in FIGS. 3 and 4, the present embodiment further provides a driving method, including the afore-described pixel driving circuit. The driving method includes Steps S1-S3 as below.

Step S1—an initial stage, at which the pixel driving circuit is initialized.

Step S2—a data input stage, at which an external integrated circuit (IC) provides a voltage to the data signal (Data), the voltage is divided by using the first storage capacitor (Cst1) and the second storage capacitor (Cst2), and the voltage is pulled down and written to the gate of the first transistor (T1). At the data input stage, the writing signal (WR), the reading signal (RD), the data signal (Data) and the reference voltage (Vref) obtain a high voltage level, all of the first transistor (T1), the second transistor (T2) and the third transistor (T3) are turned on, and the second storage capacitor (Cst2) is charged.

Step S3—a light emission stage, at which the pixel driving circuit provides a driving current which is provided to the organic light emitting element (OLED) for driving the organic light emitting element (OLED) to emit light for displaying images. At the light emission stage, all of the writing signal (WR), the reading signal (RD) and the data signal (Data) obtain a low voltage level, and the organic light emitting element (OLED) emit light.

When entering the light emission stage from, the data input stage, the writing signal (WR) is changed from a high voltage level to a low voltage level, the voltage of the data signal (Data) is pulled down, and a turned-off state is achieved by the first transistor (T1) when a black image is required to be displayed on a display panel, thereby ensuring implementation of the black image.

As shown in FIG. 4, when entering the light emission stage from, the data input stage, the writing signal (WR) is changed from the high voltage level to the low voltage level and the first storage capacitor (Cst1). When the data signal (Data) outputted by the IC is 0V, the voltage of the data signal (Data) is pulled down to a negative voltage level capable of turning off T1 and meanwhile the light emitting element (OLED) does not emit light. When the voltage of the data signal (Data) outputted by the IC is greater than 0V, the light emitting element (OLED) emits light and the strength increases as the data signal (Data) outputted by the IC increases. At the initial stage, the data input stage and the light emission stage, the reference voltage (Vref) is at the high voltage level.

The following is illustrated by examples.

Various voltages are set in the pixel driving circuit as: VDD=24 V; VSS=0 V; WR: Vgh=20V, Vgl=−4 V; RD: Vgh=20V, Vgl=−4 V; Data=0 V; Vref=2 V.

It is assumed that Vth=−5V, Cst1: Cst2=1: 5; Vth_T1=−3 V, Vth_OLED=2 V.

At the instant time WR is switched off, the voltage of T1 gate will be pulled down due to voltage division of the capacitor. In ideal case, an amount of voltage changed is represented by:

$$\Delta Vg = \frac{Cst1}{Cst1 + Cst2} \times (Vgl - Vgh) = \frac{1}{1+5} \times (-4 - 20) = -4;$$

Accordingly, when a black image or black screen is achieved by a display panel, Vgs−Vth¬T1=Data−Vref−Vth_T1=0−4−2+3=−3V<0, T1 is in a turned-off state, and the light emitting element (OLED) cannot be activated. In such a way, the black screen is achieved. Vgs is the voltage between the gate and the source of the first transistor (T1) and Vth is a threshold voltage. As can be seen, the voltage of the data signal (Data) written to the gate of the first transistor (T1) is always changed with ΔVg and an equivalent voltage of the data signal (Data) for the black screen is at a negative voltage level, thereby achieving the black screen by the display panel.

Above analysis is based on an ideal case. Actual value of ΔVg may differ from a designed value. Those of ordinary skill in the art may design an experiment with a plurality of groups of different capacitance of Cst1 and Cst2 and select the capacitance based on results so as to obtain a desired ΔVg, thereby achieving a pure black screen.

In the present embodiment, a ratio of capacity of the first storage capacitor (Cst1) to capacity of the second storage capacitor (Cst2) is greater than 0.2. This ensures that in the process of driving the pixel driving circuit, the gate of the first transistor (T1) is divided by voltage, thereby achieving the black screen, ensuring that the light emitting element (OLED) will not be activated, and improving the contrast of the display panel.

Compared to the existing arts, the present embodiment provides a pixel driving circuit and a driving method thereof, and a display panel, and by appropriately designing capacitance of the two capacitors and dividing a gate voltage of the first transistor (T1), it can be ensured that a black screen is achieved and contrast of a display panel is improved even though a negative drift is seriously caused on a threshold voltage of T1.

The present embodiment further provides a display panel. The display panel is an organic light emitting diode (OLED) display panel, which includes a pixel array and pixel driving circuits providing a driving current to organic light emitting diodes in the pixel array. The pixel driving circuits are served by the afore-described pixel driving circuit.

In the above embodiments, different emphasis is placed on respective embodiments, and reference may be made to related depictions in other embodiments for portions not detailed in a certain embodiment.

Hereinbefore, a pixel driving circuit and a driving method thereof, and a display panel provided in the embodiments of the present application are introduced in detail, the principles and implementations of the embodiments are set forth herein with reference to specific examples, descriptions of the above embodiments are merely served to assist in understanding the technical solutions and essential ideas of the present application. Those having ordinary skill in the art should understand that they still can modify technical solutions recited in the aforesaid embodiments or equivalently replace partial technical features therein; these modifications or substitutions do not make essence of corresponding technical solutions depart from the spirit and scope of technical solutions of embodiments of the present application.

The invention claimed is:

1. A pixel driving circuit, comprising:

a first transistor (T1), a gate of the first transistor (T1) connected to a first node (A), a source of the first transistor (T1) connected to a second node (B), a drain of the first transistor (T1) fed by a power source voltage (Vdd);

a second transistor (T2), the gate of the second transistor (T2) connected to a third node (C) and fed by a writing signal (WR), the source of the second transistor (T2) fed by a data signal (Data), the drain of the second transistor (T2) connected to the second node (B);

a third transistor (T3), the gate of the third transistor (T3) fed by a reading signal (RD), the source of the third transistor (T3) connected to the second node (B), the drain of the third transistor (T3) connected to a reference voltage (Vref);

a first storage capacitor (Cst1), one end of which is connected to the third node (C) and the other end of which is connected to the first node (A);

a second storage capacitor (Cst2), one end of which is connected to the first node (A) and the other end of which is connected to the second node (B); and an organic light emitting element (OLED), an anode of which is connected to the second node (B) and a cathode of which is connected to a common ground voltage (Vss), wherein the pixel driving circuit is driven at a plurality of stages comprising:

an initial stage, at which the pixel driving circuit is initialized;

a data input stage, at which an external integrated circuit (IC) provides a voltage to the data signal (Data), the voltage is divided by using the first storage capacitor (Cst1) and the second storage capacitor (Cst2), and the voltage is pulled down and written to the gate of the first transistor (T1); and a light emission stage, at which the pixel driving circuit provides a driving current which is provided to the organic light emitting element (OLED) for driving the organic light emitting element (OLED) to emit light for displaying images, wherein at the data input stage, the writing signal (WR), the reading signal (RD), the data signal (Data) and the reference voltage (Vref) obtain a high voltage level, all of the first transistor (T1), the second transistor (T2) and the third transistor (T3) are turned on, and the second storage capacitor (Cst2) is charged.

2. The pixel driving circuit according to claim 1, wherein a ratio of capacity of the first storage capacitor (Cst1) to capacity of the second storage capacitor (Cst2) is greater than 0.2.

3. The pixel driving circuit according to claim 1, wherein the first transistor (T1), the second transistor (T2) and the third transistor (T3) are any one of a low temperature poly-silicon thin-film transistor, an oxide semiconductor thin-film transistor and an amorphous-silicon (a-Si) thin-film transistor.

4. The pixel driving circuit according to claim 1, wherein all of the writing signal (WR), the reading signal (RD) and the data signal (Data) are provided by the external integrated circuit (IC).

5. The pixel driving circuit according to claim 1, wherein the first transistor (T1) is configured to provide a driving current to the organic light emitting element (OLED) and brightness of the organic light emitting element (OLED) is controlled by the driving current.

6. The pixel driving circuit according to claim 1, wherein when entering the light emission stage from the data input stage, the writing signal (WR) is changed from a high voltage level to a low voltage level, the voltage of the data signal (Data) is pulled down, and a turned-off state is achieved by the first transistor (T1) when a black image is displayed on a display panel.

7. The pixel driving circuit according to claim 1, wherein at the light emission stage, all of the writing signal (WR), the reading signal (RD) and the data signal (Data) obtain a low voltage level, and the organic light emitting element (OLED) emit light.

8. A display panel, comprising the pixel driving circuit according to claim 1.

* * * * *